US006368154B1

(12) United States Patent
Hirata et al.

(10) Patent No.: US 6,368,154 B1
(45) **Date of Patent: *Apr. 9, 2002**

(54) SHIELDED ELECTRICAL CONNECTOR WITH GROUND CONTACT SPRING

(75) Inventors: Toshihisa Hirata, Yamato; Masami Sasao, Yokohama, both of (JP)

(73) Assignee: Molex Incorporated, Lisle, IL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/567,736

(22) Filed: May 10, 2000

(30) Foreign Application Priority Data

May 10, 1999 (JP) ..... 11-129133

(51) Int. Cl.[7] ..... H01R 13/648
(52) U.S. Cl. ..... 439/609; 439/607
(58) Field of Search ..... 439/607–610, 439/108

(56) References Cited

U.S. PATENT DOCUMENTS 5,879,193 A * 3/1999 Thenaisie et al. ..... 439/607
5,967,846 A * 10/1999 Davis et al. ..... 439/609
6,007,379 A * 12/1999 Michaelis ..... 439/607
6,012,948 A * 1/2000 Wu ..... 439/567
6,077,120 A * 6/2000 Futatsugi et al. ..... 439/607
6,190,205 B1 * 2/2001 Wu ..... 439/607

* cited by examiner

*Primary Examiner*—Gary Paumen
*Assistant Examiner*—Ross Gushi
(74) *Attorney, Agent, or Firm*—Robert J. Zeitler

(57) ABSTRACT

A shielded electrical connector is provided with features that enable miniaturization. The connector includes a shield having a ground spring for deflectably engaging a mated plug that is matably inserted with the connector. The ground spring has at least one elbow so that the ground spring has a longer effective length. For example, the ground spring may extend over more than one panel of the shield or have at least one generally angular or L-shaped segments. Also, a connector cable assembly is provided having a first plug connector and a second plug connector mounted at opposite ends of a cable. To ensure that a user can insert the respective plug connectors only into the respectively corresponding receptacle connectors, each of the plug connectors has a shield with a keying projection. The first and second plug connectors may be substantially identical, except that the keying projections of the first and second connectors are on respectively opposite sides.

16 Claims, 10 Drawing Sheets

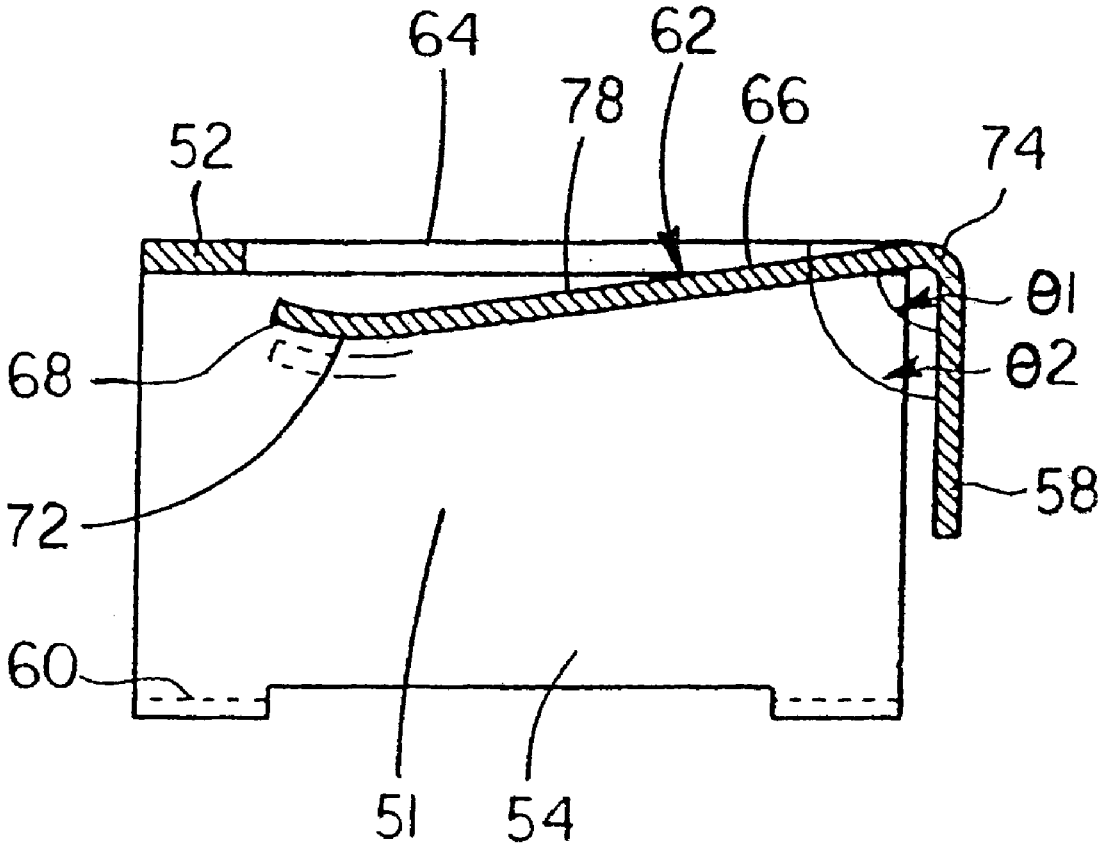
FIG. 5
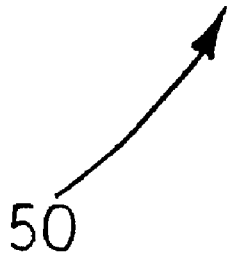

SHIELDED ELECTRICAL CONNECTOR WITH GROUND CONTACT SPRING

BACKGROUND OF THE INVENTION

The present invention generally relates to the art of electrical connectors and particularly to a connector having a shield that engages in grounding contact with a cooperatively mating connector.

Generally, known electrical connectors have included an electromagnetic shield. It is also known to establish contact between the electromagnetic shield and a cooperatively mated plug that is inserted into the connector. This is intended to provide an enhanced grounding and shielding of the connector.

In order to provide a conductive contact between the shield and the mated connector, it is further known to provide the spring with a spring that biases against the inserted mating connector. The spring is sometimes referred to in the art as a detent or a positive lock. It is known to form the spring and shield integrally from a metal sheet. In particular, the spring is defined by a cut in the shield, then formed by bending. The spring may be designed to exhibit desired forces and strength characteristics by varying the thickness (see Japanese Patent Laid-Open Publication No. Hei 10-32043).

Further, a connector cable assembly is known for a USB (Universal Serial Bus) or the like. Such an assembly includes two connectors, one on each end. In order to ensure that a user connects the cable to properly corresponding mated connectors, the shields of the connectors mounted to the cable have previously been manufactured to have respectively different shapes. Because the shapes of the respective shields and corresponding mating connectors are completely different, such connector cable assemblies have high manufacturing costs.

However, in the ongoing demand to miniaturize electronic products and to reduce production costs, the conventional connector structure is approaching its limitations. Several problems with the conventional connectors have proven difficult to overcome. By reducing the size of the connector, the length of the ground spring has necessarily also been reduced. This has made it difficult to adjust the spring biasing strength.

It is desirable to improve the performance and resiliency of the ground contact spring formed in the shield of the conventional connector without occupying more space. It is further desirable to improve manufacturing cost and efficiency, particularly by eliminating a need to fabricate the shields and bodies completely separately the connectors for connector cable assemblies.

SUMMARY OF THE INVENTION

According to an embodiment of the invention, an electrical connector is provided of the type adapted to receive a mated plug. The connector includes an insulative housing. A plurality of conductive terminals are disposed in the housing. The connector also includes a conductive shield at least partially covering the housing. The shield has a cavity within which the mated plug is received. Further, the connector includes a ground spring including an elongate, resilient body portion and a ground contact portion. The body portion of the ground spring has a mounted end integrally connected to the shield and a ground contact end distally opposite the mounted end. The ground contact end is shaped to slidably engage against the mated plug. The elongate body portion has at least one generally right-angled elbow at a location intermediately between the mounted end and ground contact ends.

In an embodiment, the shield includes at least a first panel and a second panel oriented at a generally right angle relative to each other.

In an embodiment, the resilient body portion is generally L-shaped, having a first section between the mounted end and the elbow and a second section between the elbow and the contact end, each of the first and second sections being generally planar. In an embodiment, the first and second sections are generally disposed in a common plane, such that the L-shaped body portion may reside coincident with the first planar shield panel. In another embodiment, the first and second sections are disposed in respective planes generally perpendicular to each other so that the elbow of the L-shaped body portion lies generally coincident with a corner of the first and second shield panels.

In an embodiment, the ground spring and the shield are unitary. In a related embodiment, the ground spring is defined by a cut in the shield.

An advantage of the present invention is to provide an improved connector.

Another advantage of the present invention is to provide a connector including a ground spring having substantial length in a compact space. In an embodiment, the L-shaped body portion provides the ground spring with substantial length, allowing miniaturization of the connector without sacrificing ground spring performance.

Previous attempts to miniaturize connectors have necessarily resulted in an undesirably short ground spring exhibiting undesirable spring characteristics. A further advantage of the present invention is to provide a connector wherein the ground spring has suitable flexibility and deflection characteristics.

According to an embodiment of the present invention, the shield is configured to include a first panel that extends in an insertion direction of the mated plug, the second panel extends in a direction orthogonal to the insertion direction, and wherein a first section of the body portion of the ground spring lies in the second panel, and the ground contact end lies in the first panel.

According to an embodiment of the present invention, the shield is configured to include a first panel extending in the insertion direction and the second panel has a surface extending in a direction orthogonal to the first panel, the ground spring having a mounted end joined to the first panel and an opposite ground contact end in the second panel. With this configuration, the spring member is formed to extend over the two panels of the shield, thereby to ensure a sufficient span of the ground spring.

According to another embodiment of the present invention, a connector cable assembly is provided. More particularly, the assembly cable includes a cable having a first end and a second end, a first connector being connected to the first end, and a second connector being connected to the second end. Each plug of the inventive type described above. Further, each of the plugs has a shield including key portion, such as a bump or projection, for mating and connecting with a correspondingly-keyed mated plug. This permits the connector to be mated with only with a corresponding counterpart plug.

Further, the key portion or projection can be formed integrally with the shield. As a result, the connector device can be advantageously manufactured at a low cost.

According to an embodiment of the present invention, the connectors at opposite ends of the serial bus cable are provided with respectively different key portions such that the mated plug associated with one cannot be matably received by the other. Such an embodiment advantageously prevents inadvertent misconnections.

By employing the aforementioned structure, the shield and the key portion provided thereon can be manufactured together by a simple press working. Furthermore, the position of the projection provided on the surface of the shield can be easily changed by merely changing a position of a die used for the drawing process, specifically for embossing or a half-knock process. In other words, two kinds of connectors can be manufactured by one press working facility, thereby to provide a connector device which can be manufactured at a low cost.

An advantage of the present invention is to provide an improved electrical connector.

Another advantage of the present invention is to provide an electrical connector that has improved grounding contact.

A further advantage of the present invention is to provide an electrical connector that has an improved grounding spring. A related advantage is to provide an electrical connector having a reliable grounding spring contact.

In an embodiment, the shield includes at least a first panel and a second panel oriented at a generally right angle relative to each other.

Yet another advantage is to provide an electrical connector having a reduced size.

A still further advantage of the present invention is to provide an electrical connector that can be manufactured economically with reduced costs.

Yet another advantage of the present invention is to provide a connector having a ground spring which can be easily designed to have a wide range of spring characteristics.

A still further advantage is to provide a connector that establishes and maintains a reliable a ground contact with a mated plug received therein.

Additional features and advantages of the present invention are described in, and will be apparent from, the description herein and from the drawings.

BRIEF DESCRIPTION OF THE DRAWINGS

FIG. 5 is a sectional view as taken generally along line V—V of FIG. 3.

DETAILED DESCRIPTION OF THE PRESENTLY PREFERRED EMBODIMENTS

Figure 1:
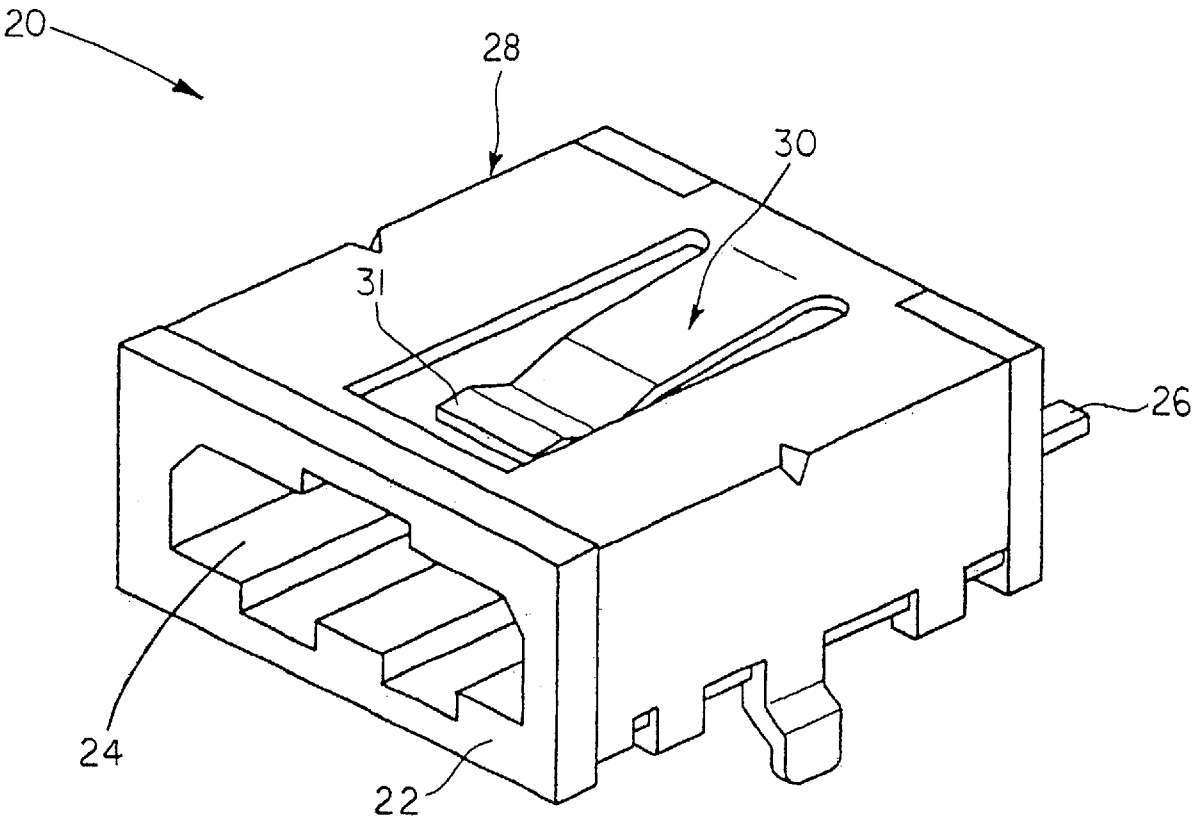
FIG. 1 (PRIOR ART)
FIG. 1 is a perspective view of a conventional electrical connector.

Now referring to the drawings, wherein like numerals designate like components, a conventional electrical connector 20 is illustrated in FIG. 1. The conventional connector 20 has an insulative housing 22 having a receptacle opening 24 at a mating side for receiving a mated plug connector (not shown) in an insertion direction. A plurality of conductive terminals 26 are disposed in the housing 22 for contacting corresponding conductors on the mated plug connector. The connector 20 further includes a conductive shield 28 that covers the housing 22. Integral with the shield 28 is a substantially straight ground spring 30 that is oriented generally along the insertion direction. The ground spring 30 has a contact portion 31 shaped to conductively contact against the mated plug connector upon the insertion thereof into the receptacle opening 24 to establish better shielding. Unfortunately, miniaturization of the connector 20 results in lessened dimensions of the ground spring 30. This makes it difficult to design the ground spring 30 to yield desired characteristics.

Figure 2:
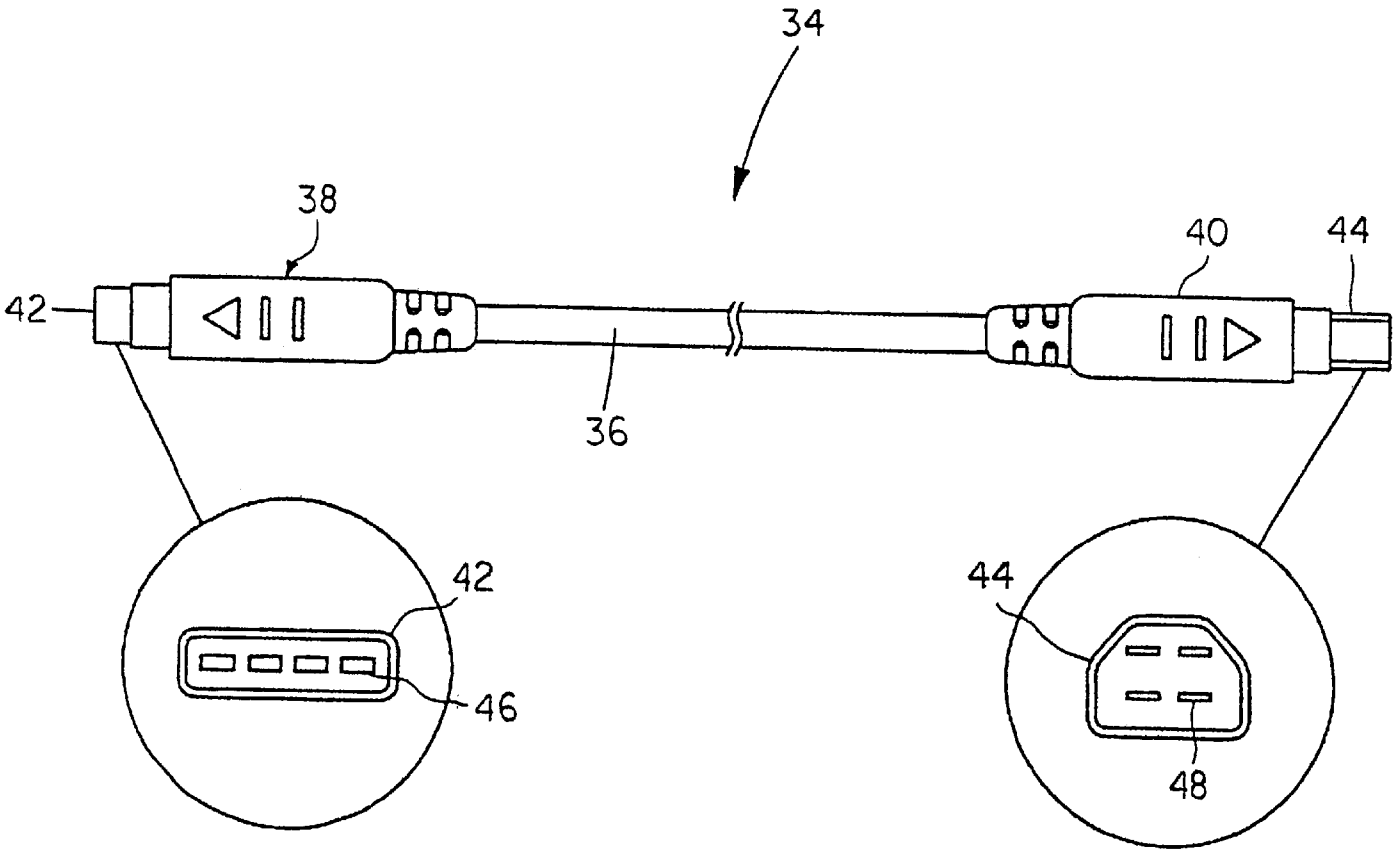
FIG. 2 (PRIOR ART)
FIG. 2 is a schematic, side, elevational view of the conventional connector cable assembly.

Referring to FIG. 2, a conventional connector cable assembly 34 is illustrated. The cable assembly 34 includes a flexible, insulated cable 36 containing wiring. A first connector 38 is mounted at a first end of the cable 36, and a second connector 40 is mounted to a second end of the cable 36. Each of the connectors 38, 40 is adapted for mating with a corresponding mated connector (not shown). Each of the connectors 38, 40 includes a respective conductive shield 42, 44 for engaging the corresponding mated connector.

To ensure that a user plugs the first and second connectors 38, 40 into only the respectively corresponding mating connectors, the connectors 38, 40 are provided with respectively different shapes. For example, as illustrated in FIG. 2, the first connector 38 has a series A type configuration, the shield 42 having a narrow, rectangular shape around a plurality of conductive terminals 46 arranged in a row. The second connector, on the other hand, has a series B type configuration, the shield 44 having a hexagonal shape surrounding a plurality of terminals 48 arranged in a rectangular pattern. The first connector 38 and second connector 40 could not be interchanged, but can only mate with a correspondingly shaped mating connector. Unfortunately, to manufacture the cable assembly 34 of FIG. 2, completely separate tooling is required to manufacture each of the different first and second connectors 38, 40. This can be costly and inefficient.

Turning now to FIGS. 3–13, various connector shields are illustrated constructed in accordance with teachings of the present invention. A shield 50 according a first embodiment is illustrated in FIGS. 3–6. The shield 50 is adapted to at least partially cover an insulating housing for receiving a mated plug connector. The shield 50 generally includes an upper panel 52, a pair of side panels 54, 56 and a rear panel 58. The rear panel 58 does not extend downwardly as far as the side panels 54, 56 to allow terminal tails (see 26 in FIG. 1) to extend rearwardly of the shield 50. Each of the side panels 54, 56 includes a pair of mounting tabs 60 for securing the shield to a surface, such as a circuit board (not shown). The mounting tabs 60 may be mounted by soldering, providing a grounded contact for the shield 50 to the circuit board. A front of the shield opens into a cavity 51 (FIG. 5) for containing a housing and terminals (not shown) of a connector within the panels 52, 54, 56. The shield 50 may be manufactured in a unitary manner by stamping and bending a metal plate. A plug connector (not shown) is inserted into the cavity 51 of the connector to effect mating.

Figure 3:
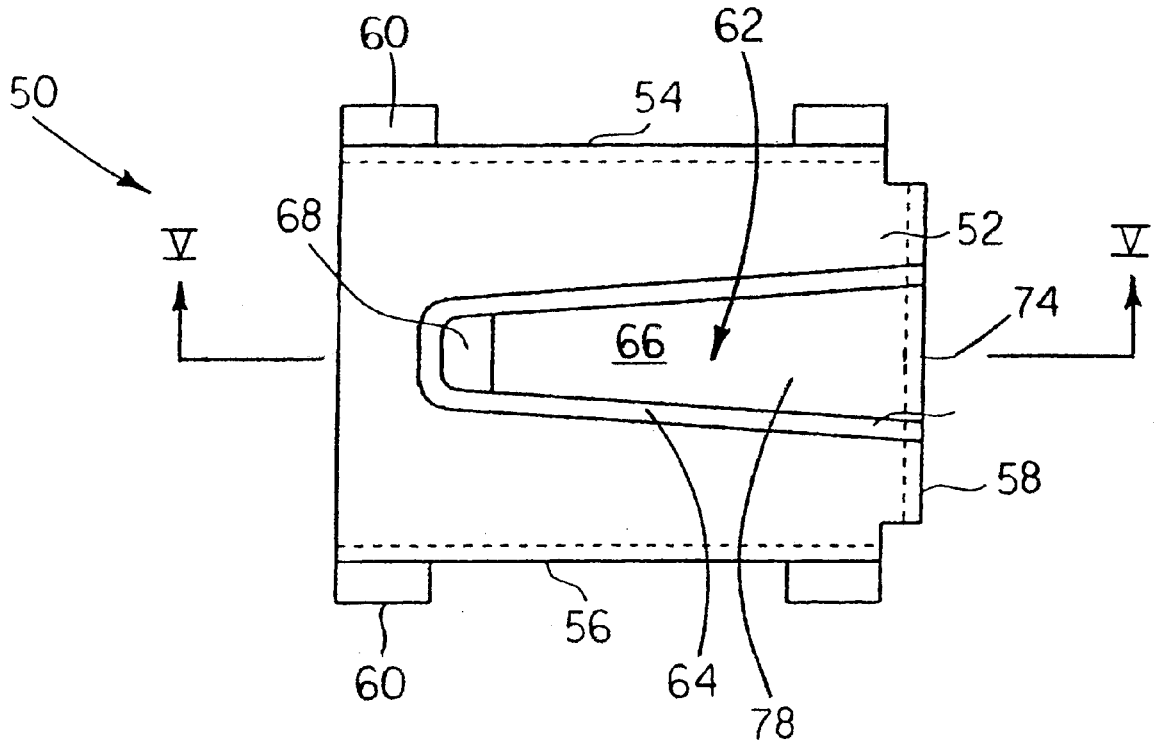
FIG. 3 is a plan view of a shield constructed in accordance with teachings of the present invention.
Figure 4:
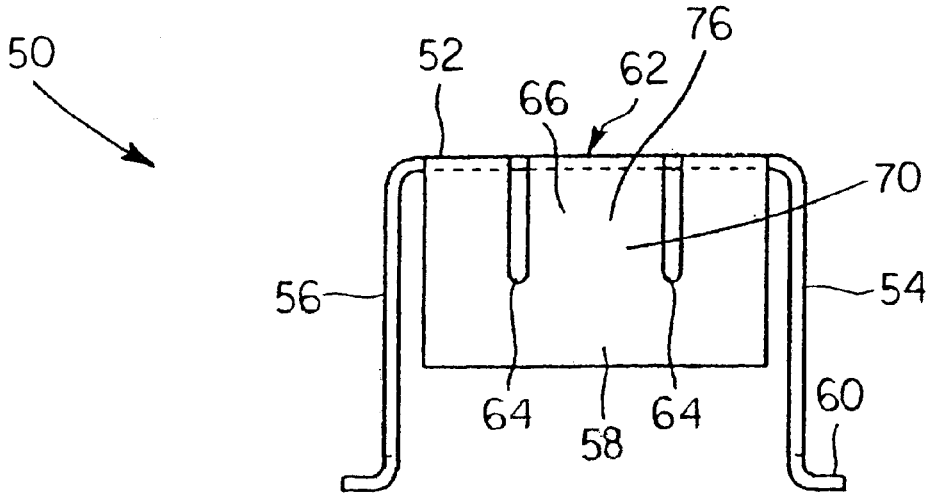
FIG. 4 is an end, elevational view of the shield of FIG. 3.
Figure 6:
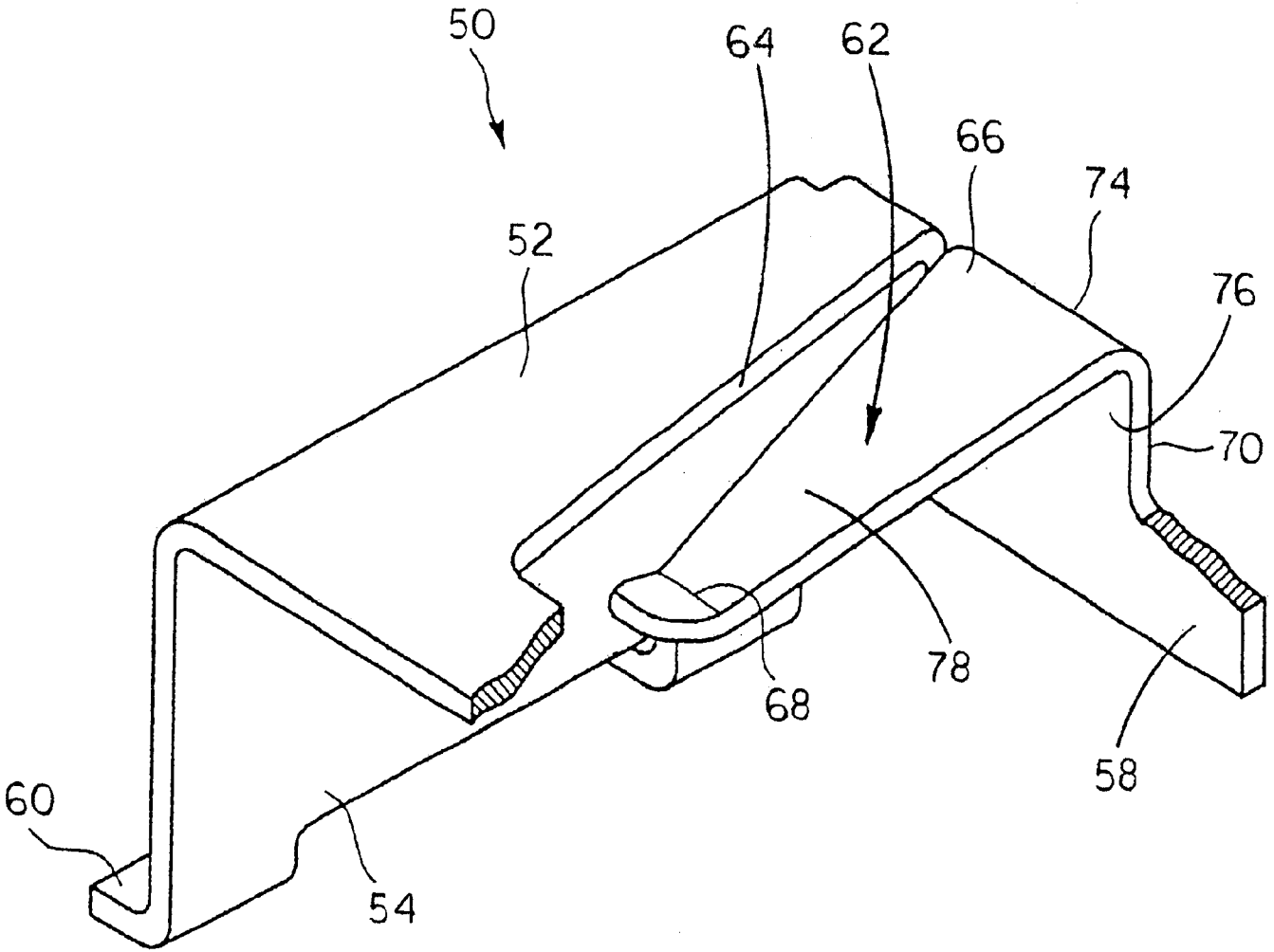
FIG. 6 is a fragmentary sectional view of the shield of FIG. 3.

For establishing grounding contact with the mated plug connect or upon insertion of the plug, and for securing the plug in an inserted position, the shield includes a ground spring 62. The ground spring 62 is unitary with the shield 50, being formed by a cut 64 in the upper panel 52 and rear panel 58. The ground spring 62 includes an elongate, resilient body portion 66 and a ground contact portion 68 (FIGS. 3 and 6). The body portion 66 has a mounted end 70 (FIGS. 4 and 6) integrally connected to the rear 58 panel of the shield 50. The ground contact portion 68 is distal from the mounted end 70.

The ground contact portion 68 is shaped to engage against the mated plug. As illustrated in FIG. 5, the ground contact portion 68 has a contact apex 72 that projects downwardly to form a point of contact against the mated plug. Also, the ground contact portion 68 has an upwardly-ramped tip for slidably engaging the mated plug connector during insertion, thus deflecting the ground spring 62 into biased contact against the plug at the contact apex 72.

To provide the ground spring 62 with enhanced spring properties, and to enhance its effective length, the elongate body portion 66 has at least one generally angled elbow 74 at a location intermediately between the mounted end 70 and the ground contact portion 68, as illustrated in FIGS. 5 and 6. The resilient body portion 66 has a first section 76 between the mounted end 70 and the elbow 74 and a second section 78 between the elbow 74 and the contact portion 68. The second section 78 is preferably oriented along a direction in which the mated plug is inserted.

In the illustrated embodiment, the first and second sections 76, 78 are disposed in respectively different planes. Referring to FIG. 5, the first section 76 normally lies in a plane common with the rear panel 58, while the second section 78 lies in a plane generally common with the upper panel 52. For example, the second section 78 angles slightly inwardly from the plane of the upper panel 52, positioning the ground contact portion 68 within the cavity 51. In particular, as shown in FIG. 5, the second section 78 is at an angle θ1 relative to the rear panel 58 which is less than an angle 2 between the rear panel 58 and the upper panel 52. As illustrated, the angle θ1 is an acute angle.

As the contact portion 68 of the ground spring 62 is pushed outwardly, the resilient body portion 66 of the ground spring 62 deflects (both the first section 76 and the second section 78). The spring 62 thereby exerts a spring bias against the mated plug connector.

According to another embodiment, a connector shield 150 is provided as illustrated in FIGS. 7–10. The shield 150 is adapted to at least partially cover an insulating housing for receiving a mated plug connector. The shield 150 generally includes an upper panel 152, a pair of side panels 154, 156 and a rear panel 158. The rear panel 158 does not extend downwardly as far as the side panels 154, 156 to allow terminal tails (see 26 in FIG. 1) to extend rearwardly of the shield 150. Each of the side panels 154, 156 includes a pair of mounting tabs 160 for securing the shield to a surface, such as a circuit board (not shown). The mounting tabs 160 may be mounted by soldering, providing a grounded contact for the shield 150 for the circuit board. A front of the shield 150 opens into a cavity 151 (FIG. 10) for containing a housing and terminals (not shown) of a connector within the panels 152, 154, 156. A plug connector (not shown) is inserted into the cavity 151 to effect connector mating.

Figure 9:
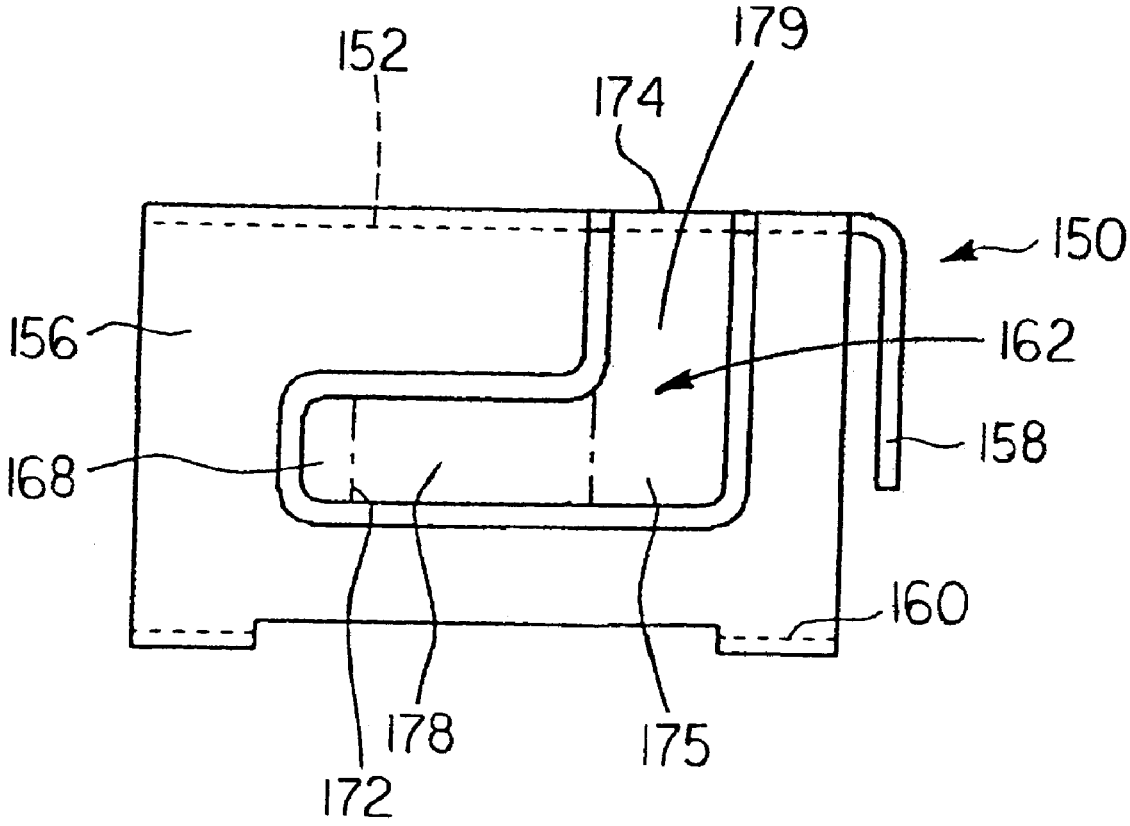
FIG. 9 is a side elevational view of the shield of FIG. 7.
Figure 10:
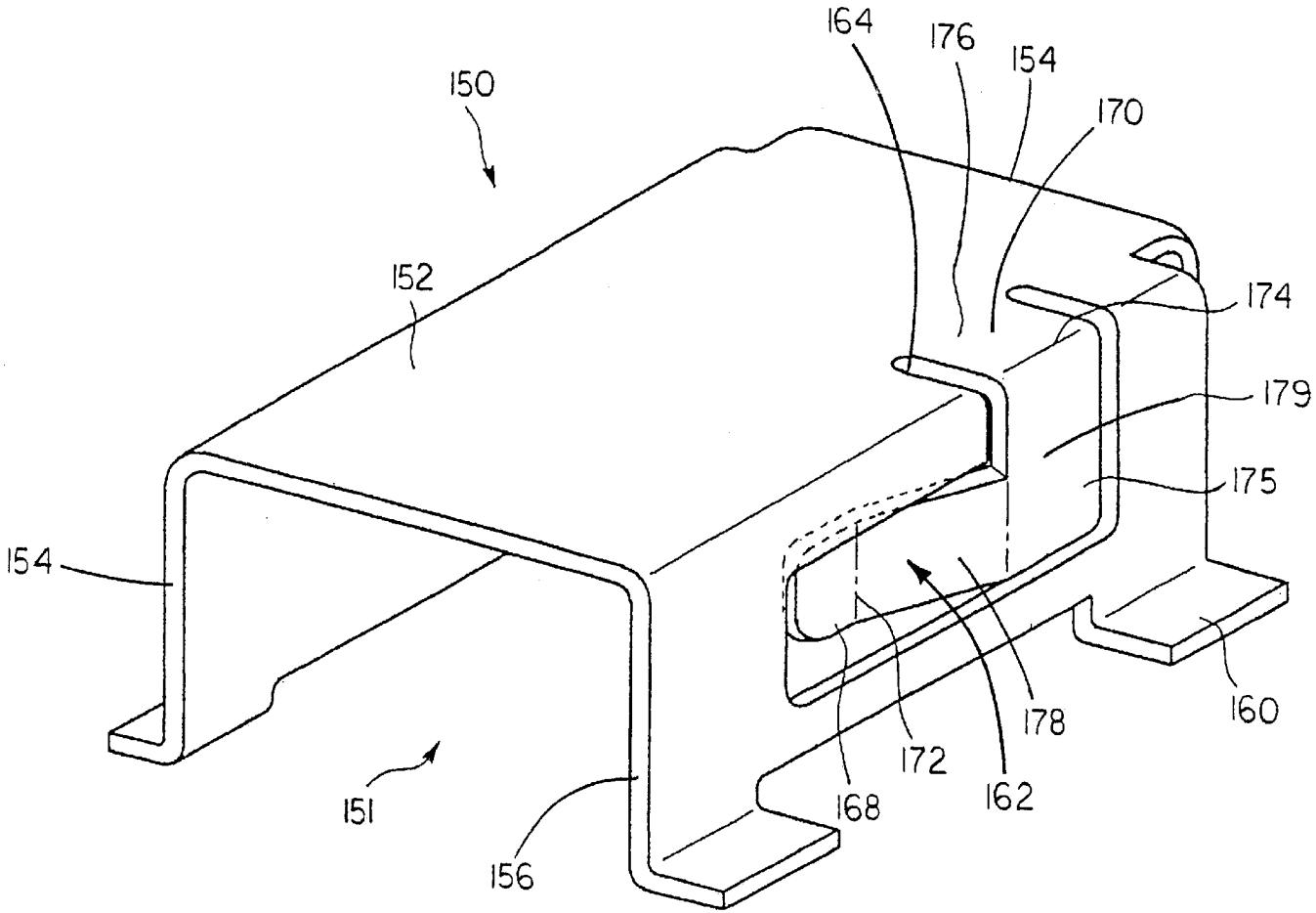
FIG. 10 is a perspective view of the shield of FIG. 7.

For establishing grounding contact with the mated plug connect or upon insertion of the plug, and for securing the plug in an inserted position, the shield 150 includes a ground spring 162. The ground spring 162 is unitary with the shield 150, being formed by a cut 164 in the upper panel 152 and side panel 158. The ground spring 162 includes an elongate, resilient body portion 166 and a ground contact portion 168 (FIGS. 9 and 10). The body portion 166 has a mounted end 170 (FIGS. 7 and 10) integrally connected to the upper panel 152 of the shield 150. The ground contact portion 168 is distal from the mounted end 170.

Figure 7:
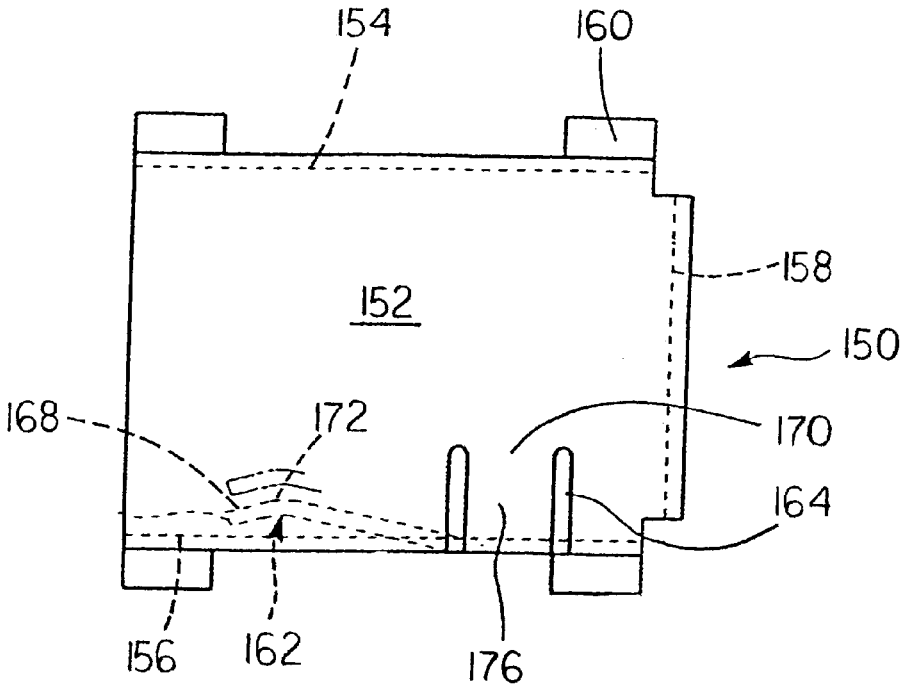
FIG. 7 is a plan view of a shield according to another embodiment of the invention.
Figure 8:
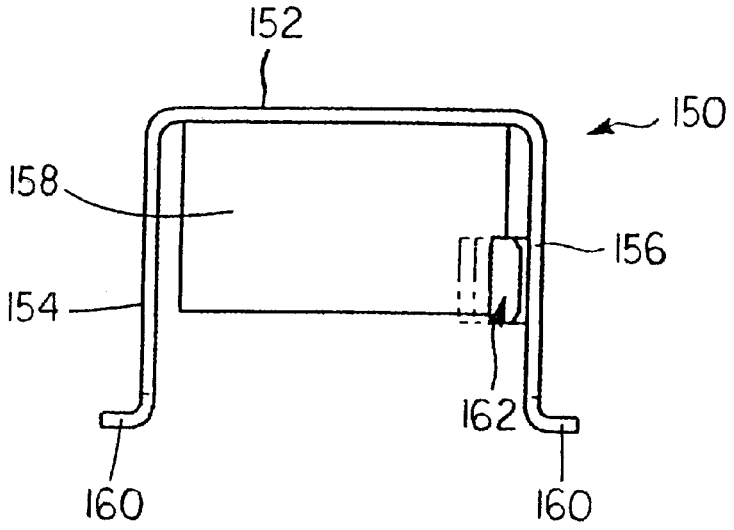
FIG. 8 is an end, elevational view of the shield of FIG. 7.

The ground contact portion 168 is shaped to engage against the mated plug. As illustrated in FIGS. 7 and 10, the ground contact portion 168 has a contact apex 172 that projects inwardly to form a point of contact against the mated plug. Also, the ground contact portion 168 has a ramped tip for slidably engaging the mated plug connector during insertion, thus deflecting the ground spring 162 into biased contact against the plug at the contact apex 172.

To provide the ground spring 162 with enhanced spring properties, and to enhance its effective length, the elongate body portion 166 has a first elbow 174 and a second elbow 175, as illustrated in FIGS. 9 and 10. Each of the elbows 154, 175 is disposed intermediately along the body portion 166 between the mounted end 170 and ground contact portion 168. The resilient body portion 166 has a first section 176 between the mounted end 170 and the first elbow 74, a third section 179 between the first elbow 174 and the second elbow 175, and a second section 178 between the second elbow 175 and the contact portion 168.

The second section 178 is preferably oriented along a direction in which the mated plug is inserted. Also, the second section 178 is angled slightly inwardly. As the contact portion 68 of the ground spring 162 is pushed outwardly, the resilient body portion 166 of the ground spring 162 deflects (both the first section 176 and the second section 178). The spring 162 thereby exerts a spring bias against the mated plug connector.

Figure 11:
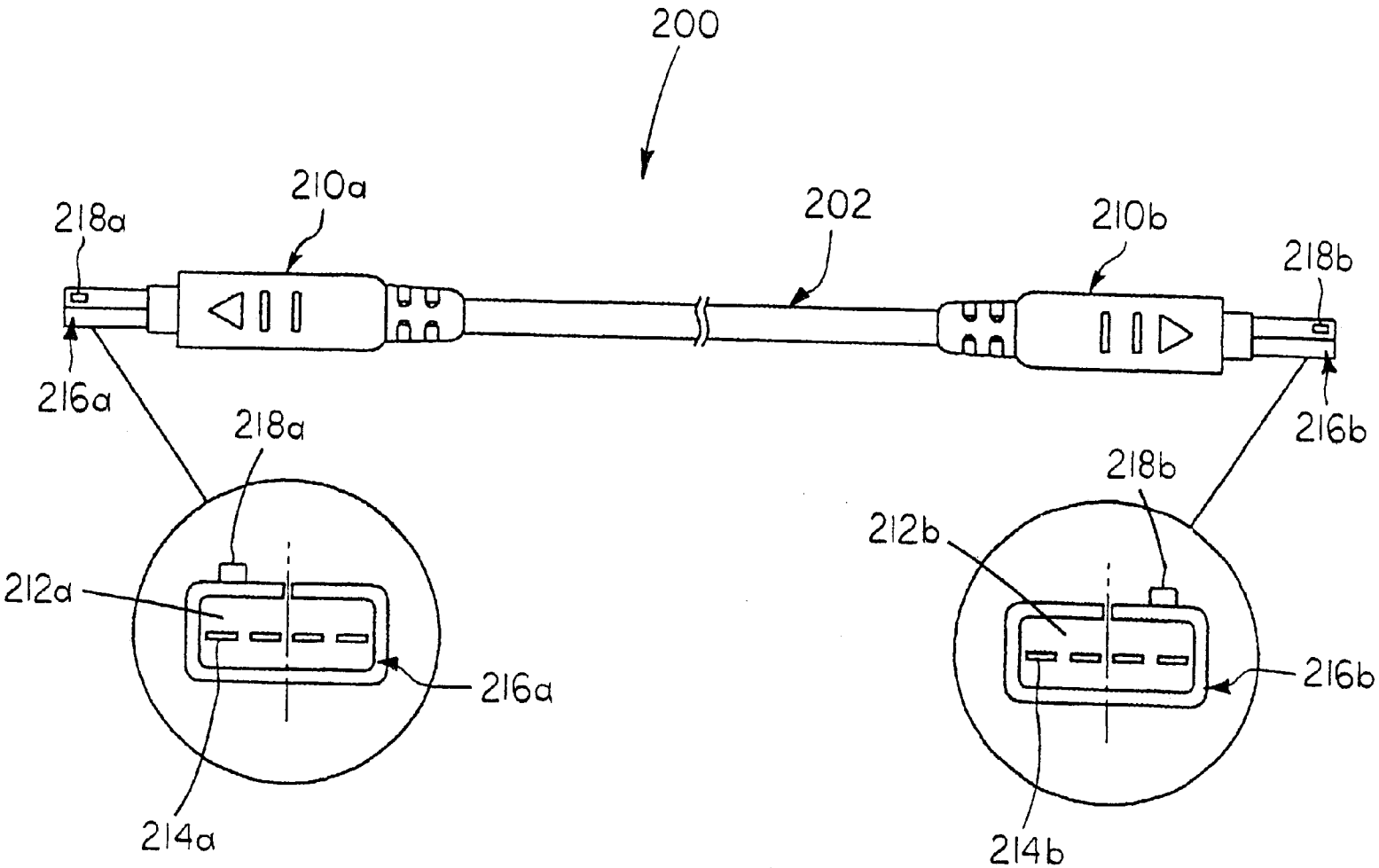
FIG. 11 is a schematic, side, elevational view of a connector cable assembly according to a further embodiment of the invention.

Now turning to FIG. 11, a connector cable assembly 200 is illustrated. The connector cable assembly includes a cable 202 having opposite first and second ends. A first plug connector 210*a* is mounted at the first end of the cable, and a second plug connector 210*b* is mounted at the second end of the cable. The first plug connector 210*a* is adapted to mate with a first receptacle connector, and the second plug connector 210*b* is adapted to mate with a second receptacle connector. For ease of reference, components of the first plug connector 210*a* are indicated herein with reference numbers containing the letter "a" and components of the second plug connector 210 are indicated with a "b."

Figure 12:
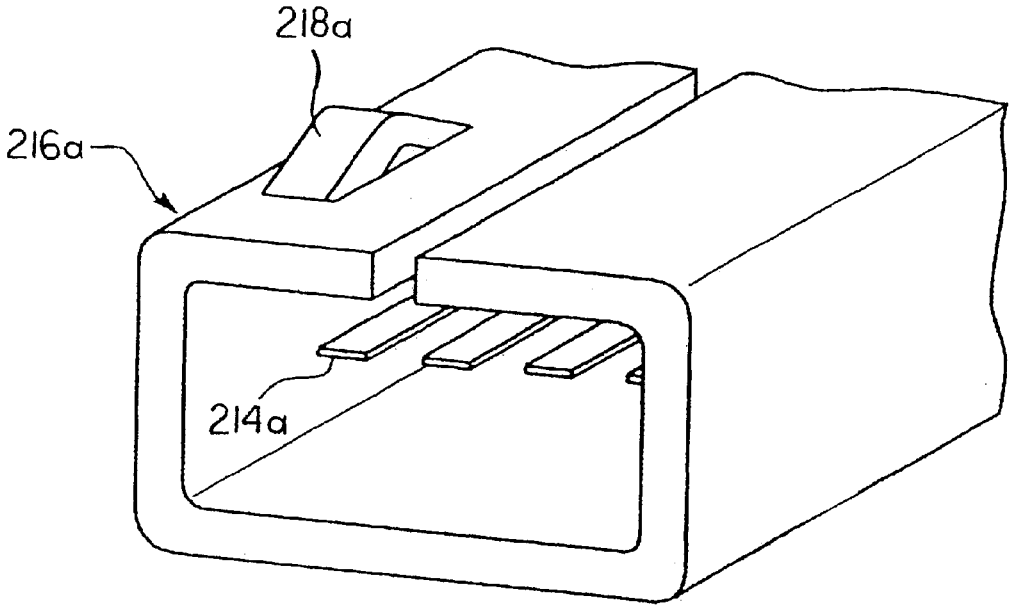
FIG. 12 is a perspective view of a first shield of the connector of FIG. 11.
Figure 13:
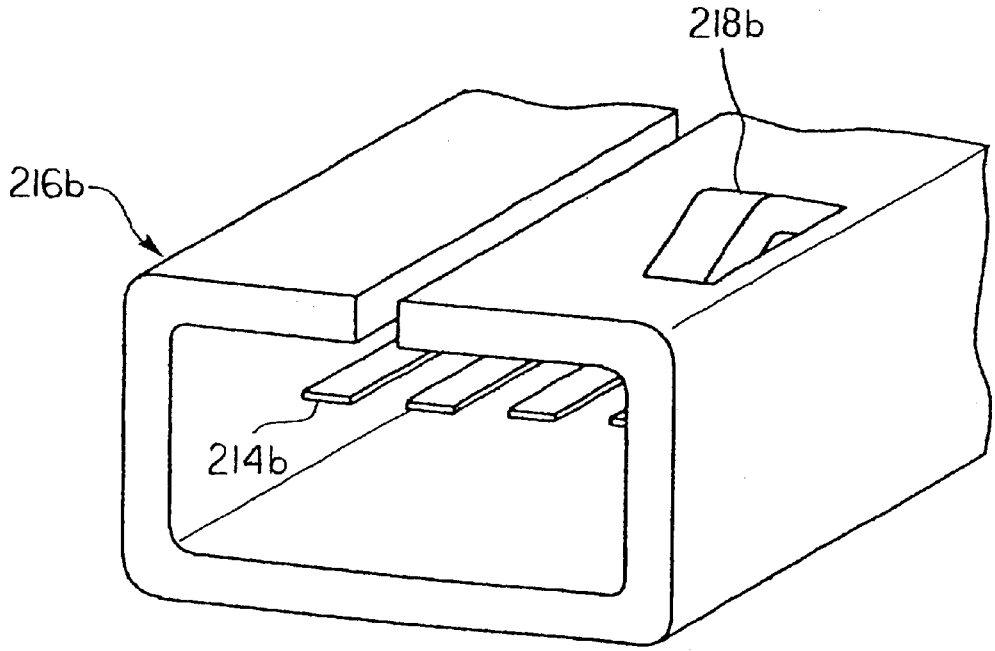
FIG. 13 is a perspective view of a second shield of the connector of FIG. 11.

As illustrated in FIGS. 11–13, each of the first and second plug connectors 210*a*, 210*b* includes an insulative housing 212*a*, 212*b* and a plurality of conductive terminals 214*a*, 214*b* disposed in the respective housing 212*a*, 212*b*. The terminals 214*a*, 214*b* are terminated to conductors in the cable 202. Furthermore, each of the plug connectors 210*a*, 210*b* includes a respective conductive shield 216*a*, 216*b*. The shield 216*a*, 216*b* at least partially covers the housing 212*a*, 212*b* of the respective connector 210*a*, 210*b*. For the sake of description, each of the connectors 210*a*, 210*b* has a respective first side and a second side as bifurcated by an imaginary central line X.

To ensure that a user can insert the first and second plug connectors into only a respectively mating receptacle, the shield 216*a* of the first plug connector 210*a* includes a keying projection 218*a* on the first side (shown left in FIGS. 11 and 12) of the shield 216*a*, and in contrast, the shield 216*b* of the second plug connector 210*b* includes a keying projection 218*b* on the second side (shown right in FIGS. 11 and 13) of the connector. The projection 218*a*, 218*b* may be formed in the respective shield 216*a*, 216*b* by a drawing process, such as, embossing or half-knock, which is applied from an inner side of the shield. The projection is slidably received within a corresponding key groove extending along an insertion direction in the mated receptacle connector.

For optimal manufacturing efficiency, the first and second connectors 210*a*, 210*b* may be substantially identical except that the projections 218*a*, 218*b* are on respectively different sides. Thus, the connectors 210*a* and 210*b* can be manufactured with shared manufacturing tooling and assembly steps, except for the simple forming of the keying projection is performed on the appropriate side.

Although the present invention has been described with reference to the preferred embodiment, it should be understood that the invention is not limited to the specific features of the described embodiment. For example, the invention is not limited to the particular shapes of the ground spring as specifically disclosed herein by way of example. Various substitutions and modifications to the present invention will be apparent to those skilled in the art. Such substitutions and modifications may be made without departing from the spirit and scope of the invention. Therefore, all such substitutions and modifications are intended to be embraced within the scope of the invention as defined in the appended claims.

What is claimed is:

1. An electrical connector adapted to receive a mated plug, the connector comprising:

an insulative housing;

a plurality of conductive terminals disposed in the housing;

a conductive shield at least partially covering the housing, the shield having a plurality of panels defining a cavity within which the mated plug is received; and a ground spring formed by a cut in a first and a second one of the panels, the first and second panels being disposed in a generally non-parallel relationship, the ground spring including an elongate, resilient body portion and a ground contact portion, the body portion having a mounted end integrally connected to the shield, the ground contact portion being shaped to engage against the mated plug, the elongate body portion having at least one generally angled elbow at a location intermediately between the mounted end and ground contact portion.

2. The connector of claim 1, wherein the second section is oriented along a direction in which the mated plug is inserted.

3. The connector of claim 1, wherein the body portion of the ground spring includes more than one of said elbows.

4. The connector according to claim 1, wherein the ground contact end is shaped to have a contact apex.

5. The connector of claim 1, wherein the shield comprises at least a first panel and a second panel oriented at an angle relative to each other.

6. The connector of claim 1, wherein the ground spring and the shield are unitary.

7. The connector of claim 6, wherein the ground spring is defined by a cut in the shield.

8. A conductive shield for an electrical connector adapted to receive a mated plug, the connector including an insulative housing and a plurality of conductive terminals disposed in the housing, the shield at least partially covering the housing, the shield having a plurality of panels defining a cavity within which the mated plug is received and a ground spring formed by a cut in a first and a second one of the panels, the first and second panels being disposed in a generally non-parallel relationship, the ground spring including an elongate, resilient body portion and a ground contact portion, the body portion having a mounted end integrally connected to the shield and the ground contact portion being distal from the mounted end, the ground contact portion being shaped to engage against the mated plug, the elongate body portion having at least one generally angled elbow at a location intermediately between the mounted end and ground contact ends.

9. The connector of claim 8, wherein the second section is oriented along a direction in which the mated plug is inserted.

10. The shield of claim 8, wherein the shield comprises at least a first panel and a second panel oriented at an angle relative to each other.

11. The shield of claim 1, wherein the ground spring and the shield are unitary.

12. The shield of claim 11, wherein the ground spring is defined by a cut in the shield.

13. The shield of claim 8, wherein the body portion of the ground spring includes more than one of said elbows.

14. The shield according to claim 8, wherein the ground contact end is shaped to have a contact apex.

15. An electrical connector adapted to receive a mated plug, the connector comprising:

an insulative housing;

a plurality of conductive terminals disposed in the housing;

a conductive shield at least partially covering the housing, the shield having a plurality of panels defining a cavity within which the mated plug is received; and a ground spring formed by a cut in a first and a second one of the panels, the first and second panels being disposed in a generally non-parallel relationship the ground spring including a resilient body portion and a ground contact portion, the body portion having a mounted end integrally connected to the shield, the ground contact portion being shaped to engage against the mated plug, the body portion having a first segment generally disposed in a first plane and extending from the mounted end, and a second segment generally disposed in a second plane and extending between the first segment and the ground contact portion, the second plane being substantially perpendicular to the first plane.

16. An electrical connector adapted to receive a mated plug, the connector comprising:

an insulative housing;

a plurality of conductive terminals disposed in the housing;

a conductive shield at least partially covering the housing, the shield having a first side, a second side generally perpendicular to the first side, and a connecting section joining the first side and the second side, and;

a ground spring formed by a cut in the first side, the connecting section and the second side and having an end integrally connected to the shield and a ground contact portion shaped to engage the mated plug.

* * * * *